US007367148B2

(12) United States Patent
Moody

(10) Patent No.: US 7,367,148 B2
(45) Date of Patent: May 6, 2008

(54) NOVELTY BATON FOR SPECTATORS

(76) Inventor: William Dean Moody, Suite 204, 8423 - 95th Avenue, Edmonton, Alberta (CA) T6S 4S6

( * ) Notice: Subject to any disclaimer, the term of this patent is extended or adjusted under 35 U.S.C. 154(b) by 91 days.

(21) Appl. No.: 11/240,574

(22) Filed: Oct. 3, 2005

(65) Prior Publication Data

US 2007/0074649 A1 Apr. 5, 2007

(51) Int. Cl.

| | |
|---|---|
| ***G09F 15/00*** | (2006.01) |
| ***G09F 21/02*** | (2006.01) |
| ***E01F 9/00*** | (2006.01) |
| ***G08B 23/00*** | (2006.01) |

(52) U.S. Cl. ..... 40/610; 40/586; 116/63 P; 340/321

(58) Field of Classification Search ..... 40/610, 40/604, 608, 586, 514, 218, 600; 116/173, 116/174, 175, 63 P; 463/39; 446/484; 404/10; 84/477 B See application file for complete search history.

(56) References Cited

U.S. PATENT DOCUMENTS

| | | | | |
|---|---|---|---|---|
| 2,909,147 | A | 10/1959 | Crowder | |
| 4,574,726 | A | 3/1986 | Sullivan | |
| 4,583,482 | A | 4/1986 | Smith | |
| 4,601,255 | A | 7/1986 | Marcotti | |
| 4,800,834 | A | 1/1989 | Feng | |
| 4,913,940 | A | 4/1990 | Pratt | |
| 4,920,910 | A | 5/1990 | Lin | |
| 4,953,905 | A * | 9/1990 | Cohen | 294/19.1 |
| 5,005,512 | A | 4/1991 | Fu | |
| 5,024,179 | A | 6/1991 | Leffel | |
| 5,115,756 | A | 5/1992 | Maffei | |
| 5,329,873 | A | 7/1994 | Tiballi | |
| 5,343,825 | A | 9/1994 | Gazecimeon et al. | |
| 5,400,437 | A | 3/1995 | Koutras | |
| D357,707 | S | 4/1995 | Moore | |
| 5,740,756 | A | 4/1998 | Ord | |
| 5,904,116 | A | 5/1999 | Wyner et al. | |
| 6,079,350 | A | 6/2000 | Parker | |
| 6,134,820 | A * | 10/2000 | Martinez | 40/586 |
| 6,378,453 | B1 | 4/2002 | Conway | |
| 6,402,116 | B1 | 6/2002 | Northup | |
| 6,748,896 | B2 | 6/2004 | Hunsley | |
| 2002/0073914 | A1 | 6/2002 | Kinehan | |
| 2003/0051381 | A1 | 3/2003 | Hernandez et al. | |
| 2003/0079389 | A1 | 5/2003 | Eberly | |
| 2006/0207142 | A1* | 9/2006 | Kochan et al. | 40/604 |

FOREIGN PATENT DOCUMENTS

| | | |
|---|---|---|
| CA | 2142191 | 8/1996 |
| CA | 2407490 | 11/2001 |
| EP | 0527478 | 2/1993 |
| WO | PCT/ZA00/00042 | 9/2000 |

* cited by examiner

*Primary Examiner*—Lesley D. Morris
*Assistant Examiner*—Syed A Islam
(74) *Attorney, Agent, or Firm*—Antony C. Edwards

(57) ABSTRACT

A baton includes an elongated flexible resilient member having a wand portion extending from a handle formed at a first end of the member and divided into two separate elongated half sections substantially longitudinally bisecting the wand portion and the handle. The two half sections may be releasably mounted to one another to form the baton.

3 Claims, 4 Drawing Sheets

NOVELTY BATON FOR SPECTATORS

FIELD OF THE INVENTION

This invention relates to a novelty baton or wand for use by spectators during sporting events, which permits a greater visual enhancement of ones personal reaction to a specific occurrence during the event. More specifically, it is a flexible baton manufactured from foam or like material, which may have streamers affixed at a distal end, a handle portion at a proximal end and a removable pennant which can be affixed intermediate the ends of the baton and marked with 'dry-erase' felt markers or the like.

BACKGROUND OF THE INVENTION

Spectators at sporting events generally desire to vociferously indicate their reaction to the performance of a player, a team or an official at suitable times during a game. Hand-held objects such as programmes, towels, elongated balloons or commercially available foam hands are commonly seen being held aloft and waved by spectators at various times during a sporting event and provide a noticeable visual reaction to a specific incident. Such spectator reaction is readily apparent to players, officials and to other spectators. Further, when such objects are waved in unison by a group of individuals, this can have the effect of enhancing the performance of a team or an individual on a team.

The novelty baton of the present invention may be manufactured from flexible foam or like material to provide a safe, reusable alternative or addition to such devices presently in use. A pennant can be removably affixed intermediate the ends of the baton and quickly marked by the user with 'dry-erase' felt tipped markers or the like, to further enhance the spectators' personal reaction to an incident occurring during the sporting event. The baton may contain a pocket or like storage area in a proximal end within which such markers can be readily stored.

In the prior art the applicant is aware of Canadian Patent Number 2,407,490, issued Nov. 1, 2001 to Olson for a Hand Held Multiple Banner and Signage Device. This device illustrates multiple flexible, flat, rectangular sheets each of which may either be folded laterally upon its centerline or joined at an edge so as to create opposing, equal sized signage sheets. A message may be displayed on a single sheet or on two adjacent sheets.

Applicant is also aware of U.S. Pat. No. Des. 357,707 issued Apr. 25, 1995 to Moore, for a Foldable Message Sign for Sporting Events. This sign is of rigid planar construction having a plurality of fold lines permitting the message sign to be accordioned outwardly from a folded to an extended configuration by gripping the opposite side edges of the banner.

Applicant is also aware of U.S. Pat. No. 4,601,255 issued Jul. 22, 1986 to Marcotti for a Flag Pole Device, generally comprising an elongated staff having a transparent, waterproof envelope open at an end, which is removably secured to the staff. An insert may be placed within the envelope and the open end of the envelope secured to the staff.

Applicant is also aware of U.S. Pat. No. 4,920,910 issued May 1, 1990 to Chu-Ying for a Foldable Display Means, which generally comprises a hollow mast or staff having an upper section hingedly secured to a lower section. A display sheet or flag secured to the upper section may be selectively, angularly positioned relative to the lower section. The lower mast section may have one or more elongated storage slots to accept both upper mast section and flag when rotated generally downwardly parallel to the lower mast section. The upper mast may accommodate a flag-marking instrument.

Applicant is also aware of U.S. Pat. No. 5,005,512 issued Apr. 9, 1991 to Shan for a Portable Extensible Flag Pole with a Flag. The flag is secured to a rotatable dowel positioned within the uppermost mast section and the uppermost mast section is provided with a slot through which the flag protrudes. Rotation of the dowel within the upper mast section allows the flag to be withdrawn from its extended aspect to a storage aspect to subsequently be suitably nested within an adjacent mast section.

SUMMARY OF THE INVENTION

The present invention is a flexible generally cylindrically shaped baton or wand manufactured from foam or like material. The baton or wand generally comprises two longitudinally elongated halves held in firm opposed facing contact by several removable, self-adhering straps for example utilizing hook and loop closure means such as Velcro™, or the like. Each half section of the baton may have a handle formed at one end and in one embodiment a plurality of flexible streamers affixed at the opposite distal end. One or both baton half sections may contain a storage pocket or recess which is readily closable by means of an exterior flexible flap, or cap, or cover or door secured to the handle portion by for example a hinge and latch or hook and loop fasteners such as Velcro™.

Thus, in summary, the baton according to one embodiment of the present invention may be characterized as including an elongated, in one embodiment generally cylindrical, flexible resilient baton for example manufactured from a resilient foam material, having a handle formed at one of its ends, wherein the baton has two separate elongated half sections, where the separate sections may be releasably held in abutting contact by suitably removable straps or other fasteners for example mounted at both ends; and in various embodiments may include one or more of:

(a) a plurality of elongated, flexible streamers at an opposite end of the baton distal from the handle, (b) a storage compartment in the handle portion of the elongate sections comprising the baton, the storage compartment for example serving as a felt marker storage pocket; such pocket to be readily closable by means of a flexible flap or other door means secured to the handle portion; and, (c) a flexible, unmarked banner or pennant (collectively herein a sheet), which is mounted to so as to extend as a generally planar surface between the two elongate half sections of the flexible baton when held apart from one another so that the pennant is taut when in a display position, the pennant mounted for example intermediate the handle and distal ends of each elongate half section, the banner for receiving spectator-specific 'dry-erase' marker graphics or markings made by the user spectator on the pennant and the markings removable therefrom by the user so that the graphics or markings may be changed by the user spectator during a sporting event, and wherein the pennant may be furled around the shaft of the baton when in a storage position and releasably fastened thereon.

DETAILED DESCRIPTION OF EMBODIMENTS OF THE INVENTION

Figure 1:
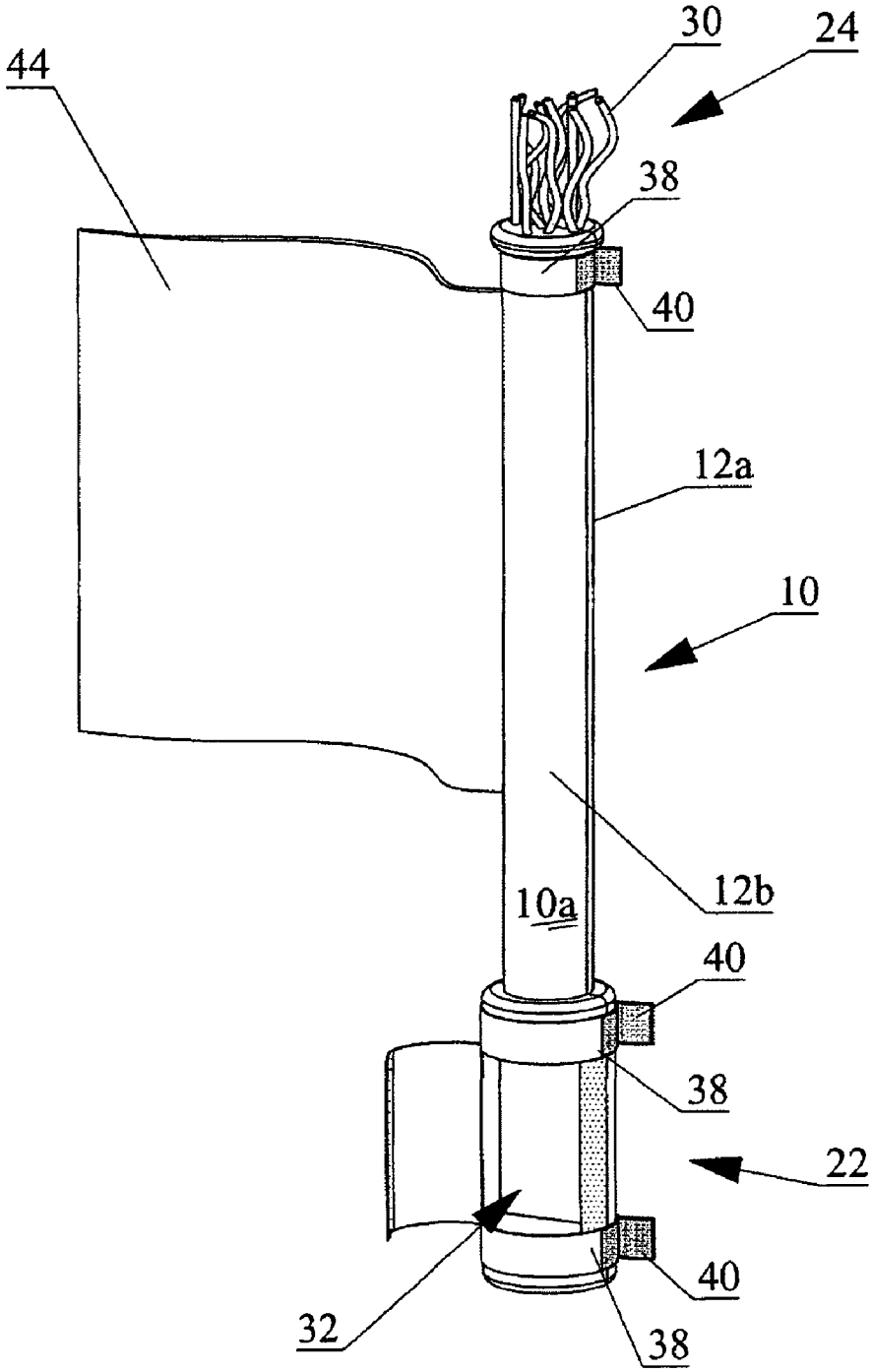
FIG. 1, is a perspective view of the novelty baton including pennant and streamers.
Figure 1A:
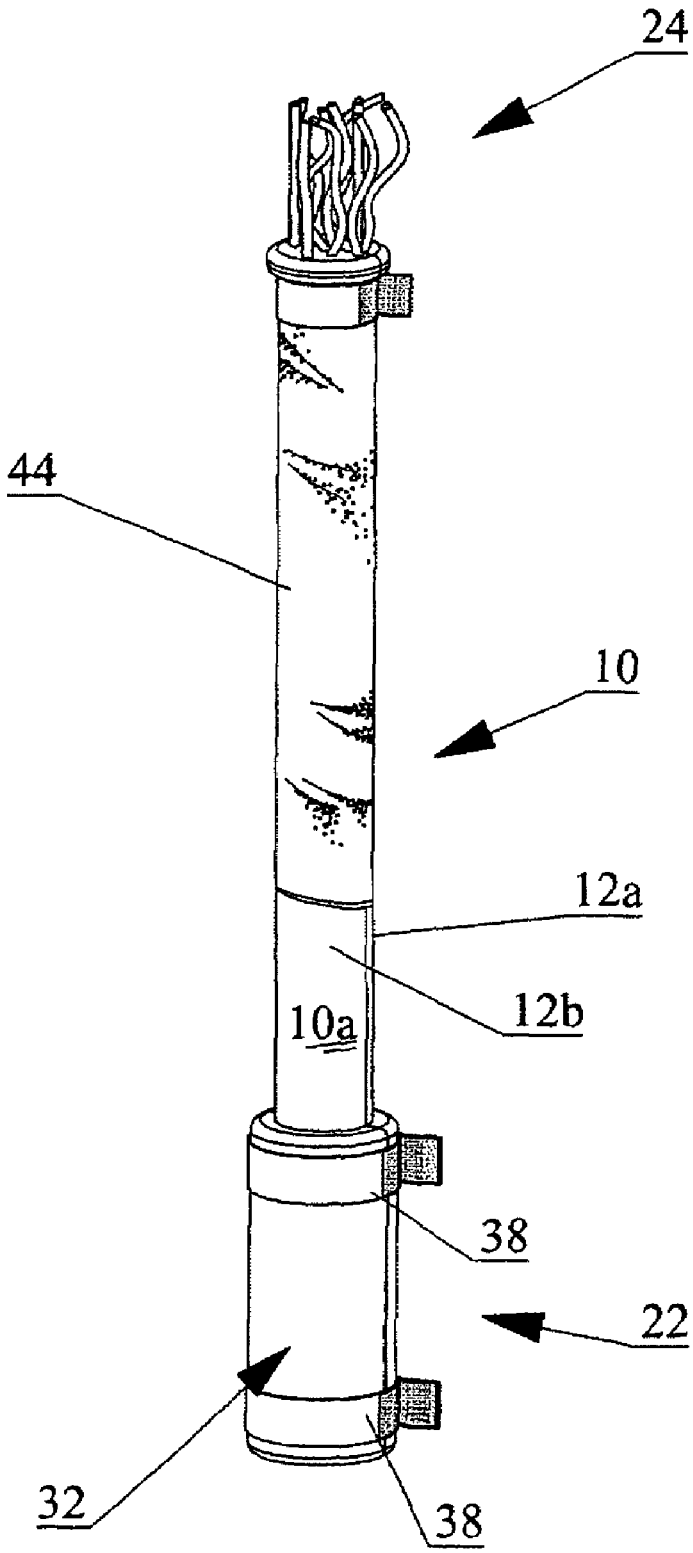
FIG. 1*a* is the baton alone.
Figure 2:
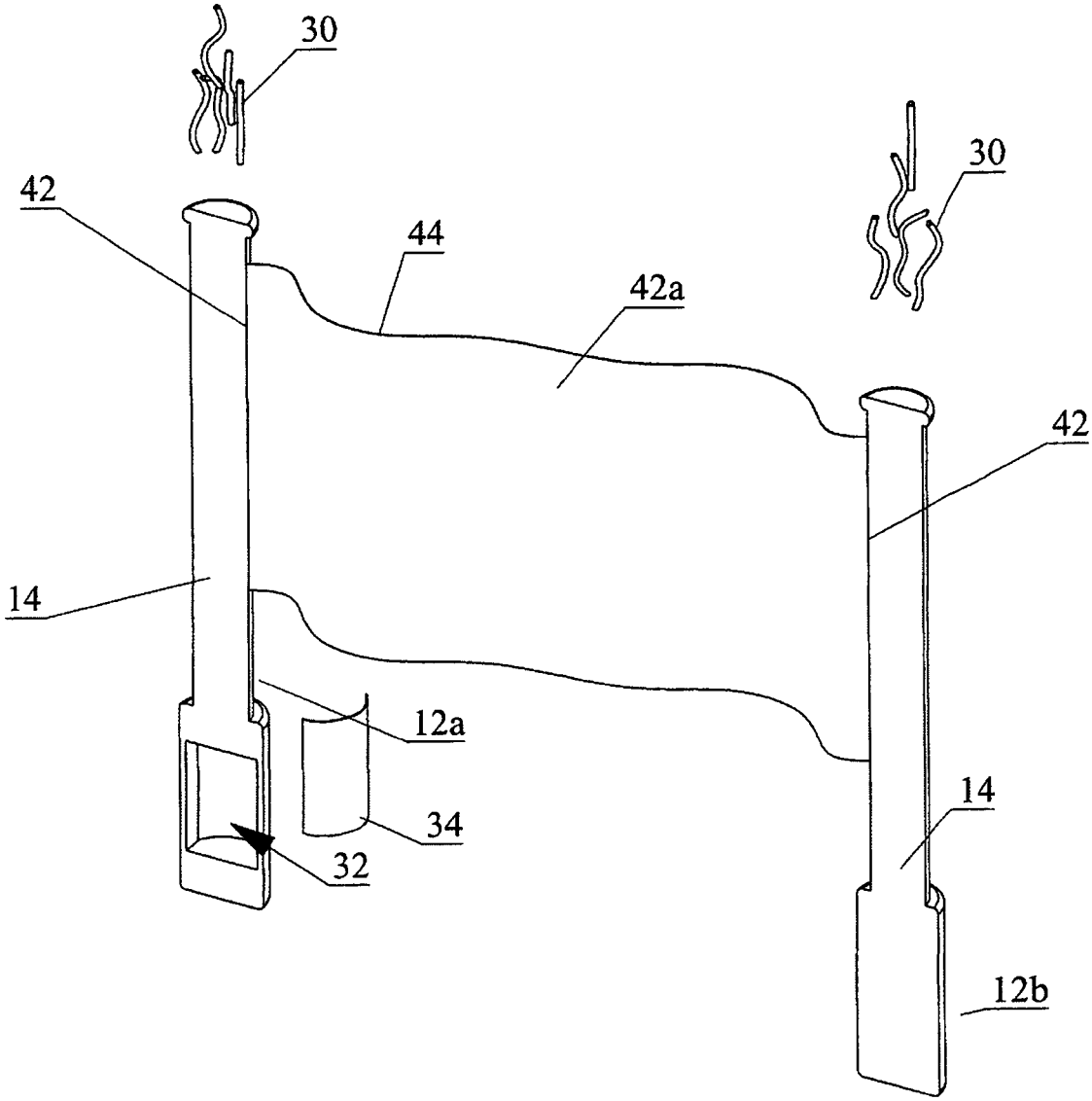
FIG. 2 is an exploded perspective view illustrating a pair of baton and pennant combinations.

With reference to the drawing figures, wherein similar characters of reference denote corresponding parts in each view, the novelty baton or wand 10, generally comprises two separate elongated half sections 12*a* and 12*b*. Baton 10 has a curved outer surface 10*a*. Half sections 12*a* and 12*b* each have a planar mating face 14. A handle end of each elongated half section may be of enlarged diameter to form a handle 22 while the opposite distal end 24 may have a plurality of flexible streamers 30 affixed thereto. The handle end of one or both of baton sections 12*a* and 12*b* may have a pocket or recess 32 formed therein within which so-called dry-erase markers or the like (not shown) may be stored. A cover or door 34 may be provided to secure the contents of pocket 32 against loss.

Removable straps 38 which may be strips of hook and loop fastening material, may be selectively mounted at both the handle end, and distal end of baton 10 so as to retain elongated half sections 12*a* and 12*b* in firm, abutting contact. Straps 38 which in one form may also be flexible resilient plastic or fabric-like material, have suitable releasable closure means such as mating strips 40 of hook and loop fabric closure means such as Velcro™ strips secured to opposite sides of the straps, at opposite ends thereof.

Figure 3:
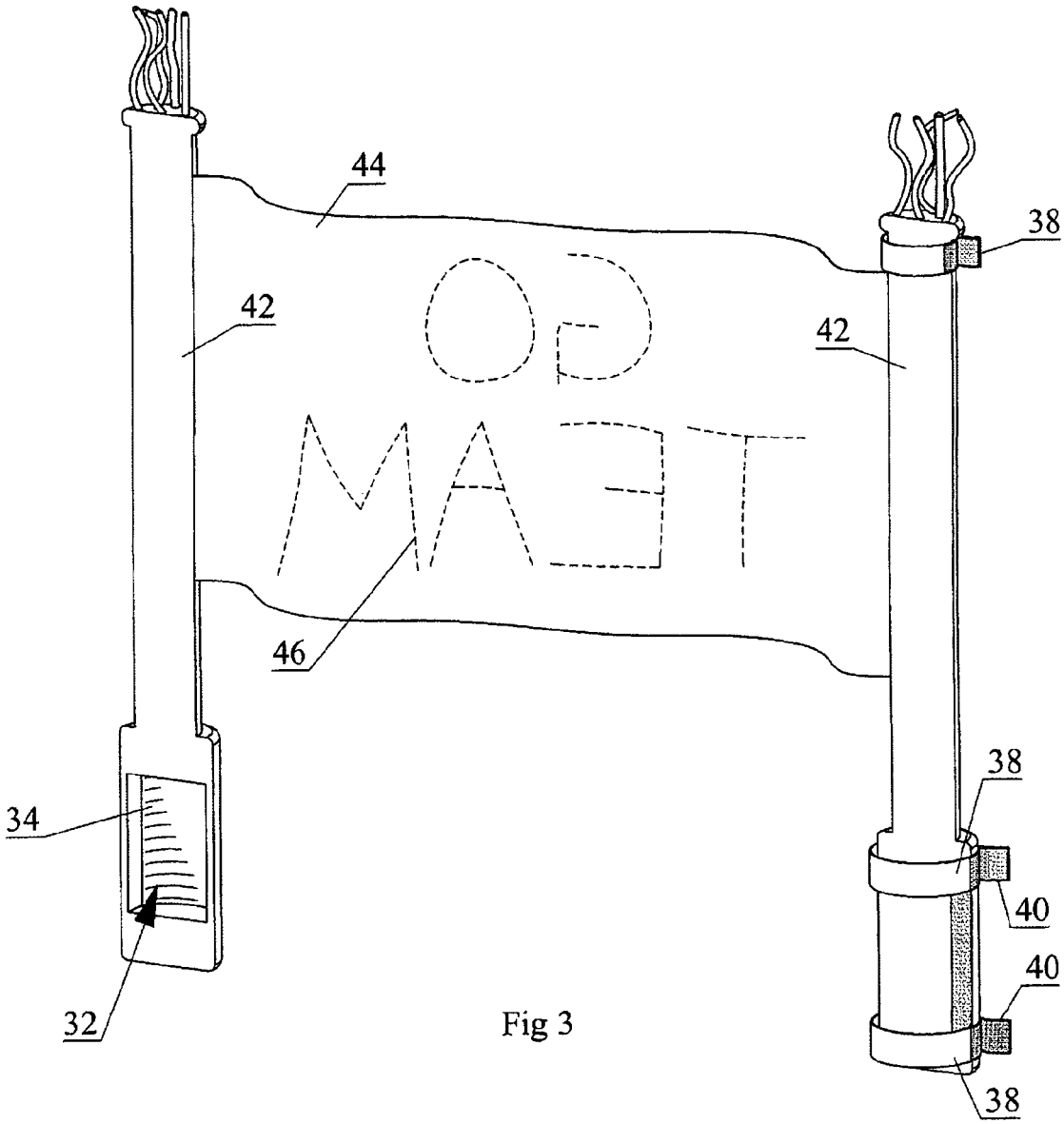
FIG. 3 is a perspective view illustrating a pair of baton and pennant combinations, in partial cut-away section, where two pennants have been joined.

Straps 38 retain the planar mating faces of the pair of elongate half sections 12*a* and 12*b* in firm close contact. Opposite side edges 42 of a banner or pennant, collectively a pennant 44, are mounted to half sections 12*a* and 12*b* so that when the banner is unfurled from its furled storage wrapped around baton 10 as seen in FIG. 1, the half sections may be held spread apart as seen in FIG. 3 so as to display the banner in a substantially planar orientation between the half sections of the baton. Banner 44 thus provides a surface upon which a user may write. Preferably banner 44 provides a writing surface on which the markers will leave legible markings 46, and further preferably, markings which may be wiped off with a hand or cloth so as to clear the banner surface for further markings. A strap 38 at the distal end of the baton may be mated through a slit on pennant 44.

Novelty baton 10 may be conveniently utilized with pennant 44 either furled, or in one embodiment detached from the baton. Gripping baton 10 by handle 22 and violently waving or shaking it aloft during a sporting event will nonetheless enhance a spectators' enjoyment. It is envisioned that since the components comprising baton 10, that is handle 22, elongate half sections 12*a* and 12*b* and streamers 30 may be brightly colored and thus make the spectator's reaction readily noticeable by the players and the officials.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A baton comprising an elongated flexible resilient member having a wand portion extending from a handle formed at a first end of said member and wherein said member is divided into two separate elongated half sections substantially longitudinally bisecting said wand portion and said handle, said member having mounted thereto means for releasably mounting said half sections together, said baton further comprising a flexible writing sheet adapted to be erasably marked by a marker pen and mounted at opposite sides of said sheet to corresponding said half sections to so as to extend, when in a display position, between said two elongate half sections when said half sections are held apart from one another, said sheet mounted generally intermediate said handle and distal ends of each of said elongate half sections so as to be substantially planar when said half sections are held apart with said sheet taut therebetween.

2. The baton of claim 1 wherein a storage compartment is formed in said handle, a door mounted to said handle for releasably sealing said storage compartment.

3. The baton of claim 1 wherein said sheet is furled around said member when in a storage position and retained in said storage position by releasable fasteners.

* * * * *